US007515839B2

(12) United States Patent
Hatanaka

(10) Patent No.: US 7,515,839 B2
(45) Date of Patent: Apr. 7, 2009

(54) IMAGE FORMING APPARATUS WITH WIRELESS COMMUNICATION FUNCTION BETWEEN TONER CARTRIDGE AND DEVELOPING UNIT

(75) Inventor: Hiroshi Hatanaka, Kitakatsuragi-gun (JP)

(73) Assignee: Kyocera Mita Corporation (JP)

( * ) Notice: Subject to any disclaimer, the term of this patent is extended or adjusted under 35 U.S.C. 154(b) by 129 days.

(21) Appl. No.: 11/649,198

(22) Filed: Jan. 3, 2007

(65) Prior Publication Data

US 2007/0166060 A1 Jul. 19, 2007

(30) Foreign Application Priority Data

Jan. 13, 2006 (JP) ..... 2006-006303

(51) Int. Cl.
*G03G 15/08* (2006.01)

(52) U.S. Cl. ..... 399/27; 399/262

(58) Field of Classification Search ..... 399/27, 399/119, 262, 267
See application file for complete search history.

(56) References Cited

U.S. PATENT DOCUMENTS 6,912,365 B2 * 6/2005 Ueno et al. ..... 399/27 X
7,346,285 B2 * 3/2008 Nagahama et al. ..... 399/27 X

FOREIGN PATENT DOCUMENTS

JP 2003-271042 9/2003

* cited by examiner

*Primary Examiner*—Sandra L Brase
(74) *Attorney, Agent, or Firm*—Gerald E. Hespos; Anthony J. Casella

(57) ABSTRACT

A toner-cartridge-side wireless communication device is attached to a bottom wall of a toner cartridge. A developing-unit-side wireless communication device is attached to an inner position of a toner cartridge mounting portion of a developing unit. The toner-cartridge-side wireless communication device and the developing-unit-side wireless communication device are arranged as opposed to each other, thereby performing stable communication between the toner-cartridge-side wireless communication device and the developing-unit-side wireless communication device.

9 Claims, 7 Drawing Sheets

IMAGE FORMING APPARATUS WITH WIRELESS COMMUNICATION FUNCTION BETWEEN TONER CARTRIDGE AND DEVELOPING UNIT

BACKGROUND OF THE INVENTION

1. Field of the Invention

The present invention relates to an image forming apparatus for developing an electrostatic latent image, using a magnetic toner.

2. Description of the Related Art

In recent years, there have been known image forming apparatuses constructed in such a manner that an RFID (Radio Frequency Identification) tag is attached to a developing unit, as a developing-unit-side RFID tag, and another RFID tag is attached to a toner cartridge for supplying toner to the developing unit, as a toner-cartridge-side RFID tag to communicate various data between the RFID tags. In the conventional image forming apparatuses, the toner-cartridge-side RFID tag is attached to an upper surface of an upper cover of the toner cartridge, and the developing-unit-side RFID tag is attached to a bottom wall of a toner cartridge mounting portion for mounting the toner cartridge therein.

Japanese Unexamined Patent Publication No. 2003-271042 discloses a wireless communication system constructed in such a manner that an RFID tag is provided in a space between an upper end portion of a cartridge component, and a main body of an image forming apparatus, or a space between a lower end portion of the cartridge component and the apparatus main body; and a main-body-side antenna is provided sufficiently close to an RFID-tag-side antenna to perform desirable communication between the RFID tag as a wireless communication device, and the apparatus main body.

The height of the magnetic toner contained in the toner cartridge is lowered, as the magnetic toner is consumed, and the magnetic toner flies within the space of the toner cartridge, with the result that the toner may adhere to the inner walls or the upper cover of the toner cartridge. As a result, a magnetic field between the toner-cartridge-side RFID tag and the developing-unit-side RFID tag is greatly fluctuated, which obstructs stable communication between the two RFID tags i.e. wireless communication devices. Further, the wireless communication system recited in the above publication is provided to perform desirable communication between the wireless communication device and the apparatus main body, and is not motivated to eliminate a fluctuation of the magnetic field by the magnetic toner.

SUMMARY OF THE INVENTION

In view of the above problems residing in the conventional examples, it is an object of the invention to provide an image forming apparatus that enables to perform stable communication between a toner-cartridge-side wireless communication device, and a developing-unit-side wireless communication device.

An image forming apparatus according to an aspect of the invention comprises: a toner cartridge for supplying a magnetic toner; a developing unit to which the magnetic toner is supplied from the toner cartridge, the developing unit including a toner cartridge mounting portion for mounting the toner cartridge therein; a toner-cartridge-side wireless communication device provided at a bottom wall of the toner cartridge; and a developing-unit-side wireless communication device, provided at an inner position of the toner cartridge mounting portion, as opposed to the toner-cartridge-side wireless communication device, to communicate with the toner-cartridge-side wireless communication device.

In the above arrangement, the toner-cartridge-side wireless communication device is provided at the bottom wall of a casing of the toner cartridge, and the developing-unit-side wireless communication device is provided at the inner position of the toner cartridge mounting portion, as opposed to the toner cartridge-side wireless communication device. This arrangement eliminates the need of disposing the toner cartridge between the toner-cartridge-side wireless communication device and the developing-unit-side wireless communication device. Accordingly, stable communication can be carried out without likelihood that the magnetic field between the wireless communication devices may be fluctuated by the magnetic toner adhered to side walls, an upper cover, or a like portion inside the toner cartridge. Also, since the toner-cartridge-side wireless communication device and the developing-unit-side wireless communication device are arranged in proximity to each other, stable communication is realized between the wireless communication devices.

These and other objects, features and advantages of the present invention will become more apparent upon reading the following detailed description along with the accompanying drawing.

BRIEF DESCRIPTION OF THE DRAWINGS

FIGS. 2A and 2B are external views showing a state before a toner cartridge is mounted on a developing unit shown in FIG. 1, wherein FIG. 2A is a side view, and FIG. 2B is a perspective view.

FIGS. 3A and 3B are top plan views showing a state before the toner cartridge is mounted on the developing unit shown in FIG. 1, wherein FIG. 3A shows a state that a circuit board cover is attached to the developing unit, and FIG. 3B shows a state that the circuit board cover is detached from the developing unit.

FIGS. 4A, 4B, and 4C are external views showing a toner cartridge to be mounted on the developing unit shown in FIG. 1, wherein FIG. 4A is a side view, FIG. 4B is a perspective view viewed from above, and FIG. 4C is a perspective view viewed from below.

FIGS. 5A and 5B are external views showing a state that the toner cartridge is mounted in a toner cartridge mounting portion of the developing unit shown in FIG. 1, wherein FIG. 5A is a side view, and FIG. 5B is a perspective view viewed from above.

DETAILED DESCRIPTION OF THE PREFERRED EMBODIMENTS

Figure 1:
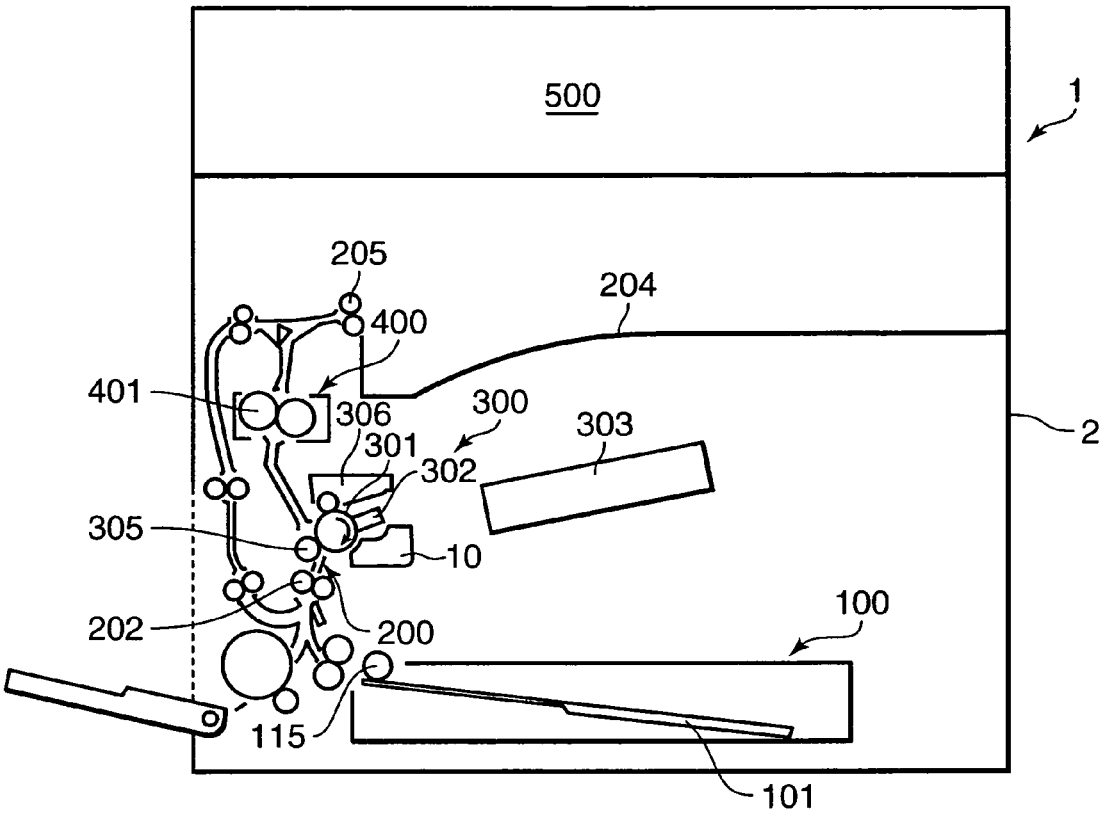
FIG. 1 is a diagram showing an entire arrangement of an image forming apparatus embodying the invention.

FIG. 1 is a diagram showing an entire arrangement of an image forming apparatus 1 embodying the invention. Examples of the image forming apparatus 1 includes a network printer, a facsimile machine, and a digital complex machine equipped with various functions as a copier, a printer, a scanner, a facsimile machine, and a like image forming device.

The image forming apparatus 1 includes a sheet feeding section 100 provided at a lower part of an apparatus main body 2, a sheet transporting section 200 provided above the sheet feeding section 100, an image forming section 300 provided above the sheet feeding section 100, an image fixing section 400 provided above the image forming section 300, and an image reading section 500 provided above the image forming section 300 and the image fixing section 400.

The sheet feeding section 100 is adapted to feed a stack of sheets placed in a sheet feeding cassette 101 one by one from an uppermost sheet thereof by a rotating operation of a sheet feeding roller 115. The sheet transporting section 200 is adapted to transport the sheet fed by the sheet feeding section 100 to the image forming section 300 by various roller pairs 202. The sheet feeding section 100 is also adapted to eject the sheet, after an image formation in the image forming section 300 and the image fixing section 400, onto a sheet ejection tray 204 provided at a side part of the apparatus main body 2 by an ejection roller pair 205.

The image reading section 500 is adapted to read image information on a document by causing an exposure lamp to irradiate light onto the document placed on a contact glass, and by introducing the reflected light from the document to a photoelectric converting section including a CCD line sensor by way of a reflective mirror. The image forming section 300 is arranged below the image reading section 500, and is adapted to form a toner image onto the sheet by an electrophotographic process. The image forming section 300 has a photosensitive drum 301 which is rotatable about an axis thereof and has photoconductivity. There are arranged around the photosensitive drum 301, along a rotating direction thereof, a charger 302, an exposure device 303, a developing unit 10, a transfer device 305, a cleaning device 306, and an electricity remover (not shown).

The image fixing section 400 is provided downstream in a sheet transport direction of the image forming section 300, and is adapted to fix the toner image on the sheet, after an image transfer in the image forming section 300, by nipping the sheet between a pair of fixing rollers 401 while heating the sheet therebetween.

A basic operation of the image forming apparatus 1 having the above arrangement is briefly described in the following. The photosensitive drum 301 which is rotated clockwise in FIG. 1 is uniformly charged by the charger 302. Then, an electrostatic latent image is formed on the photosensitive drum 301 by image exposure by the exposure device 303 including a laser scanning device, based on the image information read by the image reading section 500. The electrostatic latent image is developed into a toner image by adhering toner comprised of a magnetic material onto the electrostatic latent image by the developing unit 10.

As timed with the toner image formation, a sheet is transported from the sheet feeding section 100 via the sheet transport section 200 toward the photosensitive drum 301 in the image forming section 300 where the toner image is formed. When the sheet is transported to the photosensitive drum 301 in the image forming section 300, the toner image on the surface of the photosensitive drum 301 is transferred onto the sheet by the transfer device 305 including a transfer roller. After the toner image is transferred onto the sheet, the sheet carrying the toner image is separated from the photosensitive drum 301, and is transported to the image fixing section 400 for toner image fixation. After having been transported through the image fixing section 400, the sheet is ejected onto the sheet ejection tray 204 by way of the ejection roller pair 205. After the image transfer by the transfer device 305, the photosensitive drum 301 has toner residues and charge residues on the surface thereof removed by the cleaning device 306 and the electricity remover, and then, is charged again by the charger 302 according to needs.

Figure 2A:
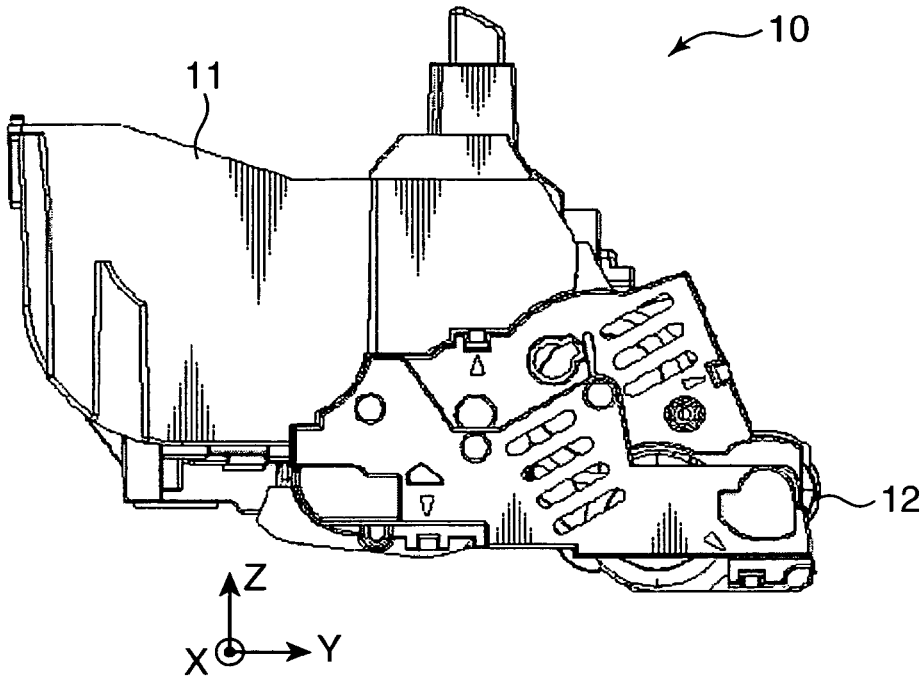
Figure 2B:
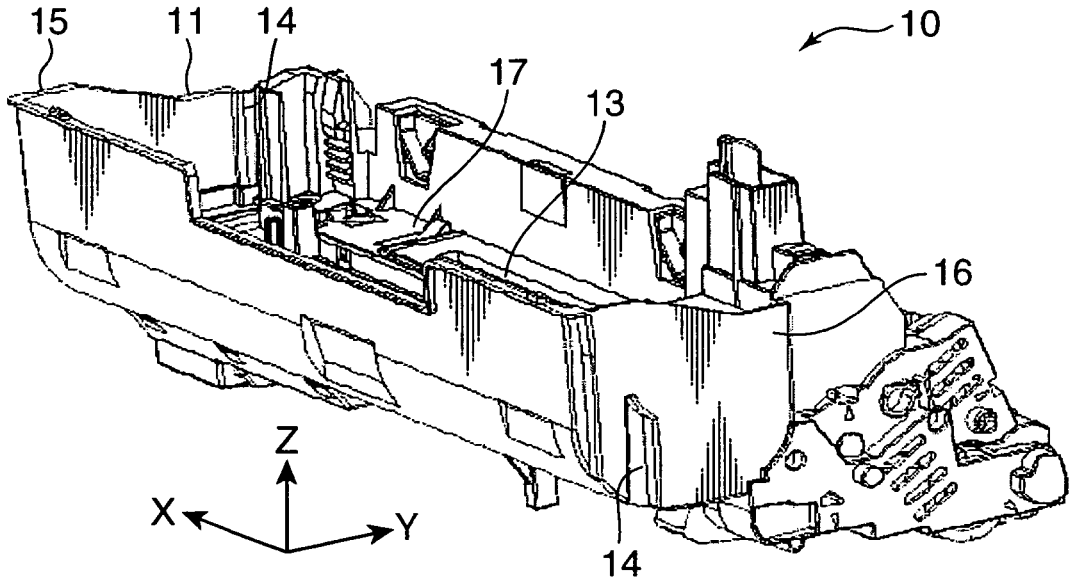
Figure 3A:
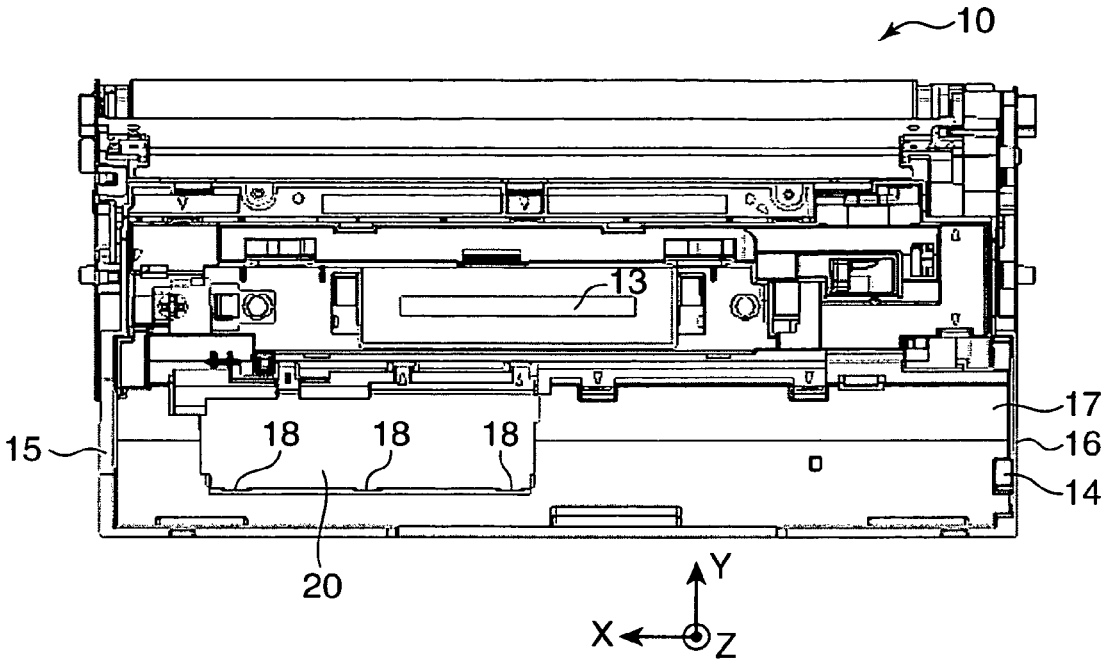
Figure 3B:
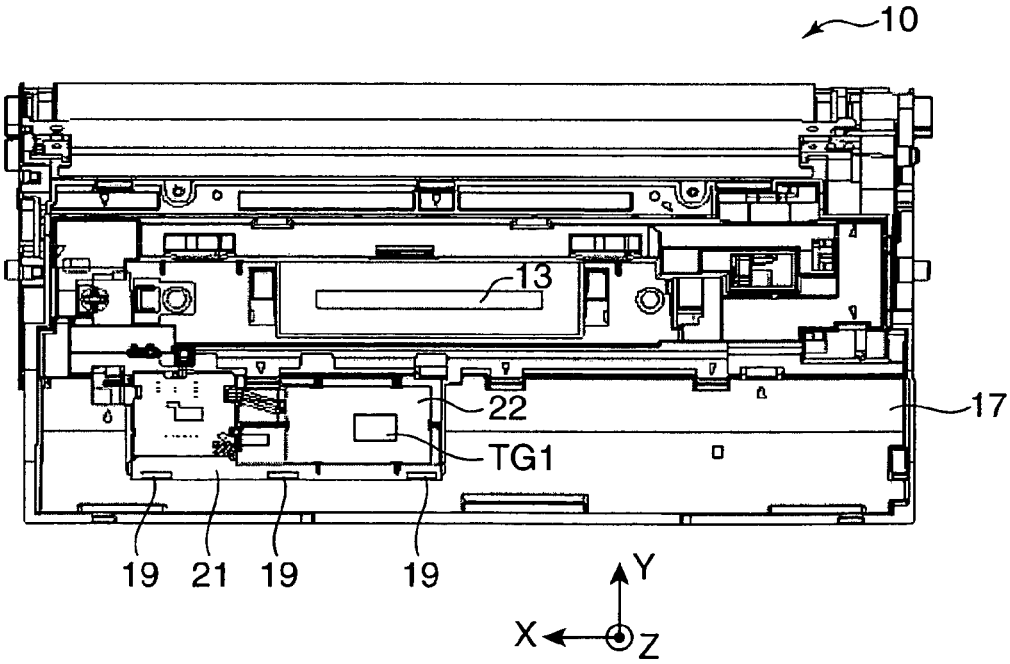

FIGS. 2A and 2B are external views showing the developing unit 10 before a toner cartridge is mounted. FIG. 2A is a side view, and FIG. 2B is a perspective view. FIGS. 3A and 3B are top plan views showing the developing unit 10 before the toner cartridge is mounted. FIG. 3A shows a state that a circuit board cover 20 is attached to the developing unit 10, and FIG. 3B shows a state that the circuit board cover 20 is detached from the developing unit 10. In FIGS. 2A, 2B, 3A, and 3B, X-axis denotes a longitudinal direction of the developing unit 10, Y-axis denotes a forward direction of the developing unit 10, and Z-axis denotes an upward direction of the developing unit 10. +X direction indicates a rightward direction, and −X direction indicates a leftward direction, viewed in the −Y direction. The plus or minus symbol is added according to needs.

As shown in FIG. 2A, the developing unit 10 has a toner cartridge mounting portion 11 for mounting a toner cartridge 30 (see FIGS. 4A through 4C) therein. The toner cartridge mounting portion 11 has a box-like shape with its opening opened upward. The toner cartridge mounting portion 11 is arranged on the rearward side of the developing unit 10 i.e. on the −Y side, and extends in the X-direction. The toner cartridge 30 is mounted in the toner cartridge mounting potion 11 through the upward opening. A developing roller 12 is arranged at an end portion on the forward side of the developing unit 10 i.e. on the +Y side. The developing roller 12 has a cylindrical shape, extends in the X-direction, and is arranged at a position opposing the photosensitive drum 301 shown in FIG. 1.

As shown in FIG. 2B, guide members 14 are formed at opposing inner side walls 15 and 16 on the both sides in the X-direction of the toner cartridge mounting portion 11 to guide the mounting of the toner cartridge 30 into the toner cartridge mounting portion 11. The respective guide members 14 extend in the Z-direction, and inwardly project from the side walls 15 and 16.

A toner supply port 13 is formed near an end portion of a bottom wall 17 of the toner cartridge mounting portion 11 on the +Y side, and near the middle position in the X-direction. The toner supply port 13 extends in the X-direction, and has a length substantially equal to one third of the length of the developing unit 10. The toner supply port 13 is an opening through which the toner supplied from the toner cartridge 30 is supplied to a toner stirring chamber, which will be described later.

The circuit board cover 20 shown in FIG. 3A is a planar member to be attached to the bottom wall 17 of the toner cartridge mounting portion 11 on the left side on the plane of FIG. 3A i.e. on the +X side. Three fixing portions 18 are substantially equidistantly formed on one side of the circuit board cover 20 i.e. on the −Y side. The fixing portions 18 project toward the −Z side. Likewise, three slits 19 as shown in FIG. 3B are formed in the bottom wall 17 at positions corresponding to the fixing portions 18 of the circuit board cover 20. Fittingly engaging the fixing portions 18 in the slits 19 enables to mount the circuit board cover 20 onto the bottom wall 17. The mounting method of the circuit board cover 20 is not limited to the above. The circuit board cover 20 may be mounted by screws or like members.

As shown in FIG. 3B, a circuit housing portion 21 is formed on the bottom wall 17 at a position where the circuit board cover 20 is mounted on the bottom wall 17. The circuit housing portion 21 is slightly recessed toward the −Z side, and has a rectangular shape in top plan view. A circuit board 22 is housed in the circuit housing portion 21. On the circuit board 22, there are mounted various electric circuits for controlling the developing unit 10, and a developing-unit-side RFID tag TG1 (hereinafter, called as "developing unit tag TG1", which is an example of a developing-unit-side wireless communication device) for sending or receiving various data to and from a toner-cartridge-side RFID tag, which is attached to the toner cartridge 30. In this embodiment, an active RFID tag is used as the developing unit tag TG1.

Figure 4A:
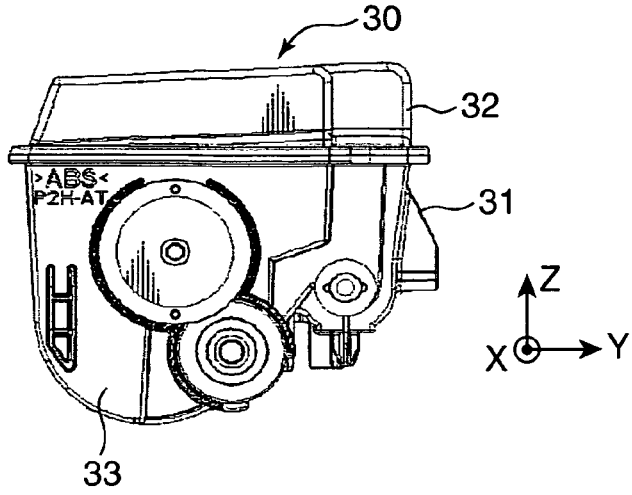
Figure 4B:
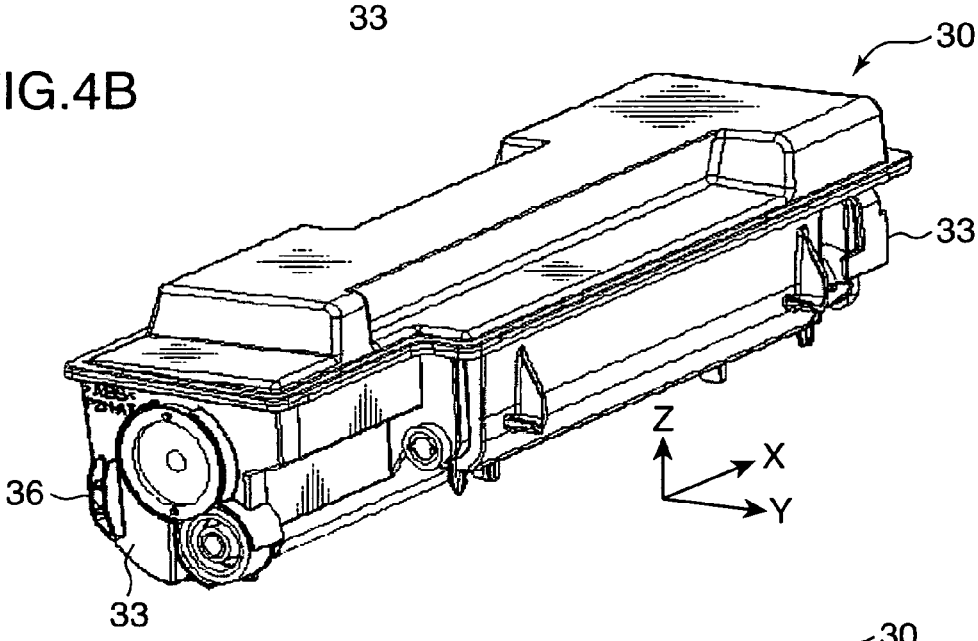
Figure 4C:
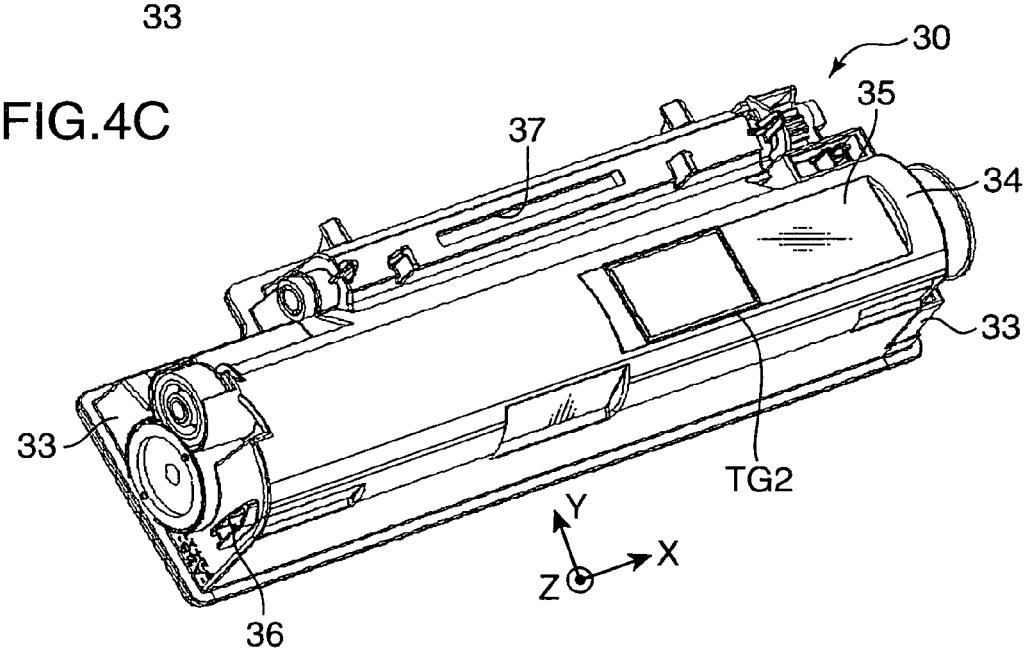

FIGS. 4A, 4B, and 4C are external views showing the toner cartridge 30. FIG. 4A is a side view, FIG. 4B is a perspective view viewed from above, and FIG. 4C is a perspective view viewed from below. The toner cartridge 30 includes a container body 31 with an elongated box-like shape, with an opening opened upward i.e. in the +Z direction, and a cover 32 for covering the opening of the container body 31. A toner comprised of a magnetic material is accommodated in the container body 31.

A toner supply port 37 is formed in an end portion of the container body 31 on the +Y side to supply the toner accommodated in the container body 31 into the toner stirring chamber through the toner supply port 13 shown in FIG. 3A. The toner supply port 37 has substantially the same size as that of the toner supply port 13 shown in FIG. 3A. When the toner cartridge 30 is mounted in the toner cartridge mounting portion 11 shown in FIG. 2B, the toner supply port 37 shown in FIG. 4C is communicated with the toner supply port 13.

A feeding screw (not shown) and a stirring/transport blade (not shown) are provided in the container body 31. The feeding screw has a spiral shape, extends in the X-direction, and has the opposite ends thereof pivotally supported on side walls 33 of the container body 31. The feeding screw is adapted to transport the toner accommodated in the container body 31 to the toner supply port 37 while rotating to supply the toner to the developing unit 10. The stirring/transport blade is rotatably supported on the side walls 33 to feed the toner accommodated in the container body 31 toward the feeding screw while stirring the toner.

As shown in FIG. 4C, a tag attaching portion 35 is formed on a bottom wall 34 of the toner cartridge 30. An area where the tag attaching portion 35 is formed is opposed to the circuit board 22 shown in FIG. 3B. On the tag attaching portion 35, there is attached a toner-cartridge-side RFID tag TG2 (hereinafter, called as "cartridge tag TG2", which is an example of a toner-cartridge-side wireless communication device). The cartridge tag TG2 is an RFID tag to be attached to the toner cartridge 30. The cartridge tag TG2 is a sealable RFID tag, and is attached to the tag attaching portion 35. In this embodiment, a passive RFID tag is used as the cartridge tag TG2. RFID tags with useful frequency bands of 13.56 MHz, 2.45 GHz, and from 860 MHz to 911 MHz may be used.

As shown in FIG. 4B, a projection 36 extending in the Z-direction is formed near an end portion on each of the side walls 33 on the −Y side. The toner cartridge 30 is mounted in the toner cartridge mounting portion 11, with the projections 36 being guided through the guide members 14 shown in FIG. 2B, whereby the toner cartridge 30 is positioned relative to the toner cartridge mounting portion 11.

Figure 5A:
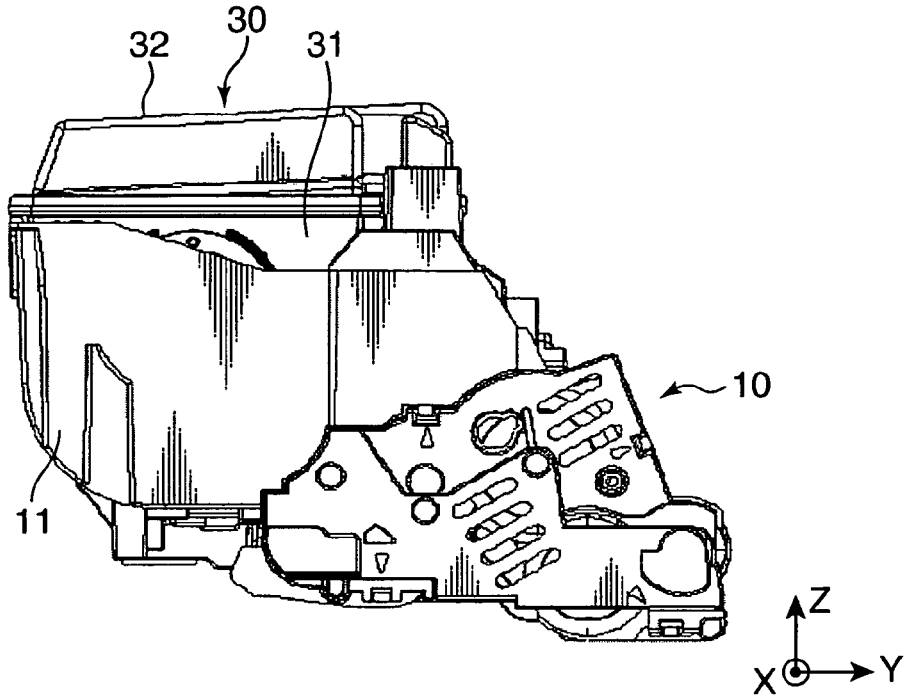
Figure 5B:
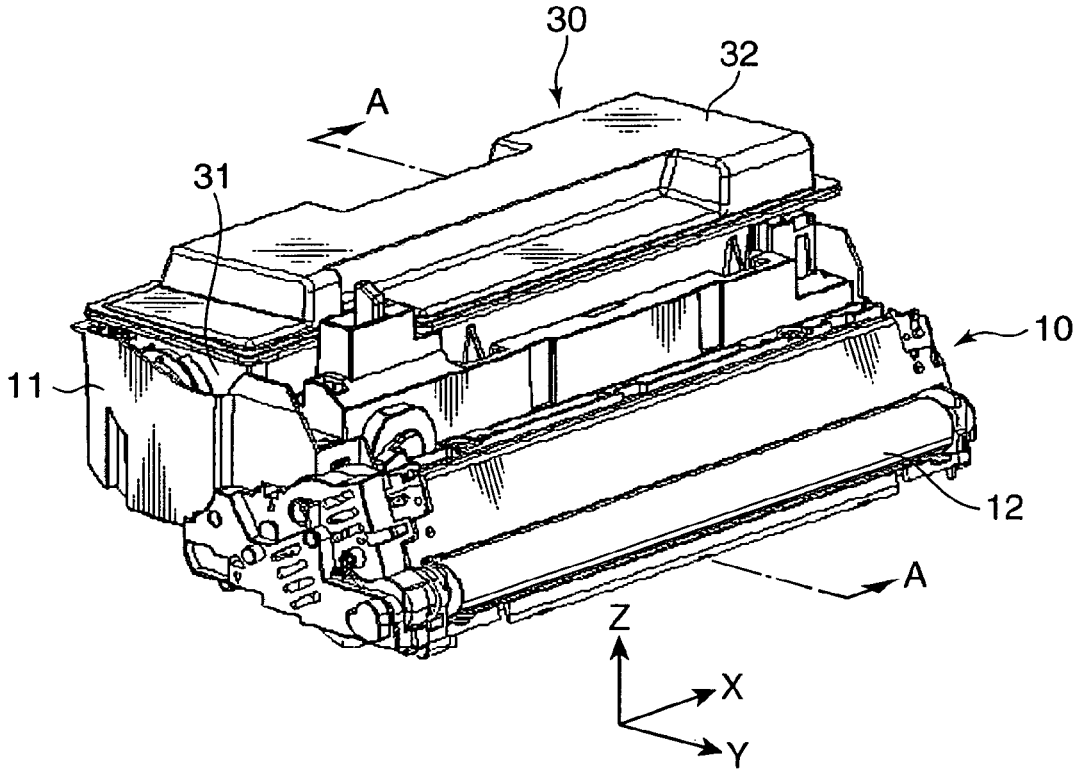

FIGS. 5A and 5B are diagrams showing the developing unit 10 after the toner cartridge 30 is mounted in the toner cartridge mounting portion 11. FIG. 5A is a side view, and FIG. 5B is a perspective view viewed from above.

Figure 6:
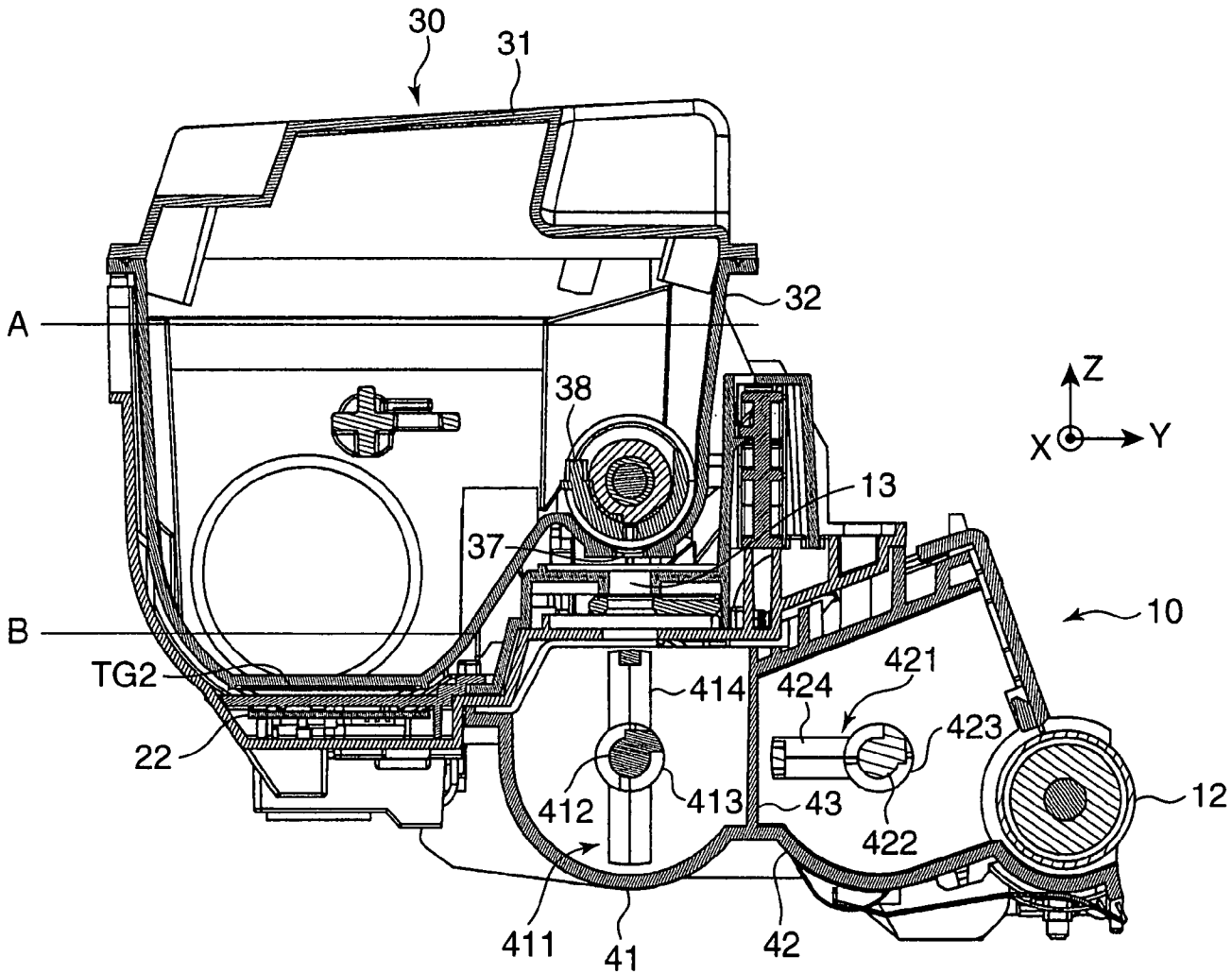
FIG. 6 is a cross-sectional view of the developing unit taken along the line A-A in FIG. 5B.

As shown in FIGS. 5A and 5B, the toner cartridge 30 is mounted in the toner cartridge mounting portion 11, with the cover 32 being exposed from the toner cartridge mounting portion 11. FIG. 6 is a cross-sectional view of the developing unit 10 taken along the line A-A in FIG. 5B. In FIG. 6, hatched portions indicate cross sections of relevant portions of the developing unit 10.

As shown in FIG. 6, a first toner stirring chamber 41 is formed at a position below the toner supply port 13, on the forward side i.e. on the +Y side of the toner cartridge 30. A second toner stirring chamber 42 is formed on the +Y side relative to the first toner stirring chamber 41. A first stirring mixer 411 extends in the X-direction within the first toner stirring chamber 41, and is rotatably supported at the both ends thereof on side walls of the developing unit 10. The first stirring mixer 411 has a first rotating shaft 412 extending in the X-direction. A first spiral portion 413 is formed on the first rotating shaft 412, with its spiral segments being aligned in the X-direction at a predetermined interval A first wing 414 is formed on the first rotating shaft 412, with its wing segments being aligned in the X-direction at a predetermined interval.

An unillustrated hollow portion is formed in a part of a partition wall 43 for separating the first toner stirring chamber 41 from the second toner stirring chamber 42 so that the toner stirred by the first stirring mixer 411 in the first toner stirring chamber 41 is fed to the second toner stirring chamber 42 through the hollow portion.

A second stirring mixer 421 extends in the X-direction within the second toner stirring chamber 42, and is rotatably supported at the both ends thereof on the side walls of the developing unit 10. The second stirring mixer 421 has a second rotating shaft 422 extending in the X-direction. A second spiral portion 423 is formed on the second rotating shaft 422, with its spiral segments being aligned in the X-direction at a predetermined interval. A second wing 424 is formed on the second rotating shaft 422, with its wing segments being aligned in the X-direction at a predetermined interval.

The developing roller 12 is provided at an end portion of the second toner stirring chamber 42 on the +Y side, with the part thereof being exposed outside. When the developing roller 12 is rotated about its axis extending in the X-direction, a thin film of toner is formed on the surface of the developing roller 12, and the toner is supplied from the developing roller 12 to the photosensitive drum 301 in FIG. 1, whereby a toner image is formed on the surface of the photosensitive drum 301. The first toner stirring chamber 41 and the second toner stirring chamber 42 are adapted to charge the toner by stirring the toner while feeding the toner in the longitudinal direction of the developing unit 10 i.e. in the X-direction.

As shown in FIG. 6, a semi-cylindrical toner shutter 38 is rotatably supported on the side walls 33 at a position above the toner supply port 37 of the toner cartridge 30 i.e. on the +Z side. In FIG. 6, before use, a peripheral portion of the toner shutter 38 is set to a lower position i.e. on the −Z side to close the toner supply port 37. In use, the peripheral portion of the toner shutter 38 is rotated and set to an upper position i.e. on the +Z side to open the toner supply port 37.

Figure 7:
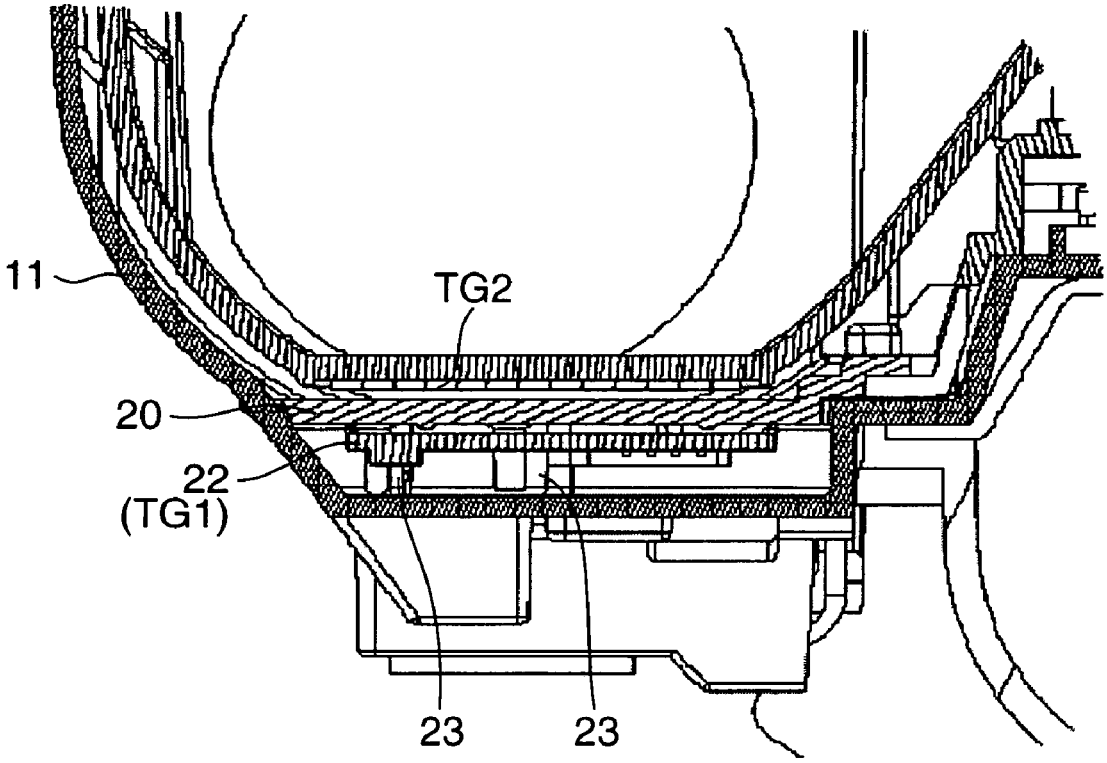
FIG. 7 is an enlarged view showing a circuit board and its periphery in FIG. 6.

FIG. 7 is an enlarged view showing the circuit board 22 and its periphery in FIG. 6. As shown in FIG. 7, the cartridge tag TG2 and the developing unit tag TAG1 attached to the circuit board 22 are opposed to each other with respect to the circuit board cover 20. The circuit board 22 is attached to a bottom wall of a casing of the developing unit 10 by screws 23.

In the following, an effect of the embodiment of the invention is described. The solid lines "A" and "B" in FIG. 6 represent height levels of the toner to be accommodated in the toner cartridge 30. The line "A" represents the height of the toner when the toner cartridge 30 is full of toner, and the line "B" represents the height of the toner when the toner cartridge 30 is short of toner. As the toner in the toner cartridge 30 is consumed, the height of the toner is lowered.

As the toner height is shifted from the position "A" to the position "B", the magnetic field between the cartridge tag TG2 and the developing unit tag TG1 is changed. As the toner is consumed, the amount of the toner accommodated in the toner cartridge 30 is decreased. Accordingly, the magnetic field change is acted in such a way that a communicable distance between the cartridge tag TG2 and the developing unit tag TG1 is increased, as the toner height is lowered. The intensity of an electromagnetic wave to be outputted from the developing unit tag TG1, and the intensity of an electromagnetic wave to be outputted from the cartridge tag TG2 are set in advance to such values that the developing unit tag TG1 and the cartridge tag TG2 can communicate with each other when the toner height is set to the position "A". With this arrangement, despite the magnetic filed change between the two tags TG1 and TG2 due to lowering of the toner height resulting from consumption of the toner, the two tags TG1 and TG2 can communicate with each other.

There is likelihood that the toner in the toner cartridge 30 may fly and adhere to the cover 32, the side walls 33, or a like portion inside the toner cartridge 30, which may greatly fluctuate the magnetic field in the toner cartridge 30.

In the conventional image forming apparatuses, since the cartridge tag is attached to the cover 32, if the toner is adhered to the cover 32 or its vicinity, a magnetic field between the cartridge tag and the developing unit tag may be greatly fluctuated, which may make it difficult or impossible for the two tags to communicate with each other.

On the other hand, in the inventive image forming apparatus 1, the cartridge tag TG2 is attached to the bottom wall 34 of the toner cartridge 30, and the developing unit tag TG1 is attached to the circuit board 22 at an inner position of the toner cartridge mounting portion 11, as opposed to the cartridge tag TG2. With this arrangement, even if the toner is adhered to the cover 32 or the side walls 33 of the toner cartridge 30, there is no likelihood that the magnetic field between the two tags TG1 and TG2 may be greatly fluctuated. This arrangement enables to perform stable communication between the two tags TG1 and TG2. Also, since the distance between the two tags TG1 and TG2 is set to a considerably short distance, as compared with the conventional image forming apparatuses, this arrangement also contributes to stable communication.

Further, since the developing unit tag TG1 and the cartridge tag TG2 are provided below the toner cartridge 30, the toner accommodated in the toner cartridge 30 constantly exists above the tags TG1 and TG2. This arrangement enables to perform stable communication without likelihood that the magnetic field between the tags TG1 and TG2 may be fluctuated by the toner which is stirred in the first toner stirring chamber 41.

As described above, an image forming apparatus according to an aspect of the invention comprises: a toner cartridge for supplying a magnetic toner; a developing unit to which the magnetic toner is supplied from the toner cartridge, the developing unit including a toner cartridge mounting portion for mounting the toner cartridge therein; a toner-cartridge-side wireless communication device provided at a bottom wall of the toner cartridge; and a developing-unit-side wireless communication device, provided at an inner position of the toner cartridge mounting portion, as opposed to the toner-cartridge-side wireless communication device, to communicate with the toner-cartridge-side wireless communication device.

In the above arrangement, the toner-cartridge-side wireless communication device is provided at the bottom wall of the casing of the toner cartridge, and the developing-unit-side wireless communication device is provided at the inner position of the toner cartridge mounting portion, as opposed to the toner-cartridge-side wireless communication device.

This arrangement eliminates the need of providing the toner cartridge between the toner-cartridge-side wireless communication device and the developing-unit-side wireless communication device. Accordingly, stable communication can be carried out without likelihood that the magnetic field between the two wireless communication devices may be fluctuated by the magnetic toner adhered to side walls, an upper cover, or a like portion inside the toner cartridge. Also, since the toner-cartridge-side wireless communication device and the developing-unit-side wireless communication device are arranged in proximity to each other, stable communication is realized between the two wireless communication devices.

Preferably, the developing unit may include a toner stirring chamber for stirring the magnetic toner supplied from the toner cartridge to supply the magnetic toner to a developing roller, and the toner stirring chamber may be provided at a position away from the developing-unit-side wireless communication device and from the toner-cartridge-side wireless communication device by a predetermined distance.

In the above arrangement, the toner stirring chamber is arranged at the position away from the developing-unit-side wireless communication device and from the toner-cartridge-side wireless communication device by the predetermined distance. This arrangement enables to suppress an influence of the magnetic toner which is stirred in the toner stirring chamber on the magnetic field between the toner-cartridge-side wireless communication device and the developing-unit-side wireless communication device, thereby enabling to perform stable communication between the wireless communications devices.

Also, in the above arrangement, as far as the toner is left in the toner cartridge to some extent, an influence of the toner which is stirred in the toner stirring chamber on the magnetic field between the wireless communication devices can be suppressed relative to the toner left in the toner cartridge. This enables to realize more stable communication.

Preferably, an intensity of an electromagnetic wave between the toner-cartridge-side wireless communication device and the developing-unit-side wireless communication device may be set to such a value as to make the toner-cartridge-side wireless communication device and the developing-unit-side wireless communication device communicable with each other when a toner accommodation capacity of the toner cartridge is set to a maximal value.

In the above arrangement, the intensity of the electromagnetic wave between the toner-cartridge-side wireless communication device and the developing-unit-side wireless communication device is set to the value to make the toner-cartridge-side wireless communication device and the developing-unit-side wireless communication device communicable with each other when the toner accommodation capacity of the toner cartridge is set to the maximal value. The height of the toner accommodated in the toner cartridge is lowered by consumption of the toner, which resultantly reduces the amount of the magnetic toner. The above arrangement enables to increase the communicable distance between the toner-cartridge side wireless communication device and the developing-unit-side wireless communication device, as the toner height is lowered. Thereby, stable communication is performed irrespective of the amount of the toner left in the toner cartridge.

Preferably, a casing of the toner cartridge mounting portion may have a cover at an inner position thereof for covering an upper surface of the developing-unit-side wireless communication device.

In the above arrangement, since the developing-unit-side wireless communication device and the toner-cartridge-side wireless communication device are arranged as opposed to each other with respect to the cover, there is no likelihood that circuits constituting the respective wireless communication devices may be short-circuited by direct contact of the wireless communication devices.

Preferably, the toner cartridge may be configured in such a manner that the toner cartridge is determined to be short of the toner when a certain amount of the magnetic toner is left in the toner cartridge.

In the above arrangement, the magnetic toner accommodated in the toner cartridge constantly exists above the developing-unit-side wireless communication device and the toner-cartridge-side wireless communication device. This enables to perform stable communication without likelihood that the magnetic field between the wireless communication devices may be fluctuated by the toner stirred inside the toner stirring chamber.

This application is based on Japanese Patent Application No. 2006-6303 filed on Jan. 13, 2006, the contents of which are hereby incorporated by reference.

Although the invention has been appropriately and fully described by way of examples with reference to the accompanying drawings, it is to be understood that various changes and/or modifications will be apparent to those skilled in the art. Therefore, unless otherwise such changes and/or modifications depart from the scope of the present invention hereinafter defined, they should be construed as being included therein.

What is claimed is:

1. An image forming apparatus comprising:

a toner cartridge for supplying a magnetic toner;

a developing unit to which the magnetic toner is supplied from the toner cartridge, the developing unit including a toner cartridge mounting portion for mounting the toner cartridge therein;

a toner-cartridge-side wireless communication device provided at a bottom wall of the toner cartridge; and a developing-unit-side wireless communication device, provided at an inner position of the toner cartridge mounting portion, wherein said developing unit has a guide member, and said toner cartridge has a projection to be guided along said guide member when mounting said toner cartridge into said developing unit to a fixed position at which a relative position between said toner-cartridge-side wireless communication device and said developing-unit-side wireless communication device is fixed; and said toner-cartridge-side wireless communication device and said developing-unit-side wireless communication device are disposed so as to always face one another at said fixed position to allow said toner-cartridge-side wireless communication device and said developing-unit-side wireless communication device to communicate under stable conditions.

2. The image forming apparatus according to claim 1, wherein the developing unit includes a toner stirring chamber for stirring the magnetic toner supplied from the toner cartridge to supply the magnetic toner to a developing roller, and the toner stirring chamber is provided at a position away from the developing-unit-side wireless communication device and from the toner-cartridge-side wireless communication device by a predetermined distance.

3. The image forming apparatus according to claim 2, wherein the toner cartridge is configured in such a manner that the toner cartridge is determined to be short of the toner when a certain amount of the magnetic toner is left in the toner cartridge.

4. The image forming apparatus according to claim 1, wherein an intensity of an electromagnetic wave between the toner-cartridge-side wireless communication device and the developing-unit-side wireless communication device is set to such a value as to make the toner-cartridge-side wireless communication device and the developing-unit-side wireless communication device communicable with each other when a toner accommodation capacity of the toner cartridge is set to a maximal value.

5. The image forming apparatus according to claim 1, wherein a casing of the toner cartridge mounting portion has a cover at an inner position thereof for covering an upper surface of the developing-unit-side wireless communication device.

6. An image forming apparatus comprising:

a developing unit having a toner cartridge mounting portion with a bottom peripheral wall and an open top opposed to the bottom peripheral wall;

a developing-unit-side wireless communication device fixedly mounted in the developing unit at a position adjacent the bottom peripheral wall of the toner cartridge mounting portion;

a toner cartridge having a bottom wall, the toner cartridge being mounted in the toner cartridge mounting portion of the developing unit so that the bottom wall of the toner cartridge is nonrotatably disposed in opposed relation to the bottom peripheral wall of the toner cartridge mounting portion, the toner cartridge including a container body for retaining a supply of a magnetic toner and being configured for supplying the magnetic toner to the developing unit;

a toner-cartridge-side wireless communication device fixedly provided adjacent the bottom wall of the toner cartridge and in fixed opposed facing relationship to the developing-unit-side wireless communication device so that the toner-cartridge-side wireless communication device and the developing-unit-side wireless communication device communicate with one another under stable conditions.

7. An image forming apparatus according to claim 6, wherein the toner cartridge is configured for selective removal from the developing unit through the open top of the developing unit.

8. An image forming apparatus according to claim 7, wherein the toner cartridge mounting portion of the developing unit further includes opposed sidewalls extending from the bottom peripheral wall thereof, guide members being formed on the opposed sidewalls of the toner cartridge mounting portion, the toner cartridge being formed with projections engaged with the guide members on the sidewalls of the toner cartridge mounting portion for preventing rotation of the toner cartridge relative to the developing unit and maintaining the opposed relationship of the toner-cartridge-side wireless communication device relative to the developing-unit-side wireless communication device.

9. An image forming apparatus according to claim 6, wherein the container body of the toner cartridge has an open top opposite the toner-cartridge-side wireless communication device, the toner cartridge further having a cover covering the open top of the container body.

* * * * *